US007393221B2

(12) United States Patent
Feng et al.

(10) Patent No.: US 7,393,221 B2
(45) Date of Patent: Jul. 1, 2008

(54) DRAWER-TYPE ALL-ON-ONE CARD CONNECTOR

(75) Inventors: Dong-Chu Feng, Huna Province (CN); Jun Li, Sichuan (CN)

(73) Assignee: Tai-Sol Electronics Co., Ltd., Taipei (TW)

( * ) Notice: Subject to any disclaimer, the term of this patent is extended or adjusted under 35 U.S.C. 154(b) by 341 days.

(21) Appl. No.: 11/376,247

(22) Filed: Mar. 16, 2006

(65) Prior Publication Data

US 2007/0103880 A1 May 10, 2007

(30) Foreign Application Priority Data

Nov. 7, 2005 (TW) ..... 94219243 U

(51) Int. Cl.
*H01R 13/62* (2006.01)

(52) U.S. Cl. ..... 439/159; 439/155

(58) Field of Classification Search ..... 439/157, 439/158, 159, 160, 155, 630
See application file for complete search history.

(56) References Cited

U.S. PATENT DOCUMENTS 6,319,028 B1 * 11/2001 Zhang et al. ..... 439/159
6,382,995 B1 * 5/2002 Bricaud et al. ..... 439/159
6,447,313 B1 * 9/2002 Zuin ..... 439/159
6,839,431 B2 * 1/2005 Ooya et al. ..... 379/433.09

* cited by examiner

*Primary Examiner*—Hien Vu
(74) *Attorney, Agent, or Firm*—Bacon & Thomas, PLLC

(57) ABSTRACT

A drawer-type all-in-one card connector includes a housing defining an insertion chamber; a plurality of card contact terminals; a sliding box slidably mounted in the insertion chamber of the housing and having a card receiving chamber for receiving one of memory cards of different specifications and a plurality of terminal slots accommodating the card contact terminals for contact with the memory card inserted into the card receiving chamber; and a cover covered on the housing, a first ejection spring stopped between the housing and the sliding box, a limiter provided between the housing and the sliding box for guiding movement of the sliding box relatively to the housing in course, and adapter means electrically connected between a circuit board and the card contact terminals of the sliding box.

10 Claims, 9 Drawing Sheets

DRAWER-TYPE ALL-ON-ONE CARD CONNECTOR

BACKGROUND OF THE INVENTION

1. Field of the Invention

The present invention relates to memory card connectors and more particularly, to a drawer-type all-in-one card connector.

2. Description of the Related Art

A regular card connector is made based on an all-in-one structure capable of receiving different memory cards, i.e., its housing has therein multiple insertion chambers and multiple sets of terminals for receiving different memory cards, such as Memory Stick (MS) card, Smart Media (SM) card, Multi-Media Card (MMC), and Secure Digital (SD) card.

A conventional all-in-one card connector has the insertion chambers separately defined without interference, i.e. two or more memory cards can be inserted into the housing at the same time. If the user inserts two or more memory cards into the housing at the same time accidentally, a reading or writing error may occur to result in malfunction of the card connector. Further, when the user inserts a memory card into the housing obliquely or improperly, the inserted memory card may damage the internal structure of the card connector.

Therefore, it is desirable to provide an all-in-one card connector that eliminates the aforesaid problems.

SUMMARY OF THE INVENTION

The primary objective of the present invention to provide a drawer-type all-in-one card connector which employs a sliding box thereof to carry one memory card only once and to keep an inserted memory card electrically connected to internal terminals thereof, thus avoiding the problems incurred while multiple memory cards are inserted.

The secondary objective of the present invention to provide a drawer-type all-in-one card connector which keeps the inserted memory card in correct electric connection with the internal terminals thereof and avoids damage incurred by oblique or improper insertion of the inserted memory card to the internal structure of the card connector.

The third objective of the present invention to provide a drawer-type all-in-one card connector which is equipped with ejection springs and a limiter for correct and automatic insertion of one memory card.

The fourth objective of the present invention to provide a drawer-type all-in-one card connector which has an arched finger notch at one end of the sliding box thereof so that the user can conveniently insert/remove a memory card into/from the sliding box.

To achieve the foregoing objects of the present invention, the drawer-type all-in-one card connector includes a housing defining an insertion chamber; a plurality of card contact terminals; a sliding box slidably mounted in the insertion chamber of the housing and having a card receiving chamber and a plurality of terminal slots for receiving corresponding memory cards of different specifications and accommodating the card contact terminals respectively; a cover covering the housing; a first ejection spring having two ends contacting against an inner sidewall of the housing and the sliding box respectively; a limiter provided between the housing and the sliding box; and adapter means having two ends electrically connected to a circuit board and the card contact terminals respectively.

Further, the adapter means includes a plurality of adapter terminals; the housing has an opening formed at one end of the insertion chamber, an upright wall formed at an opposite end of the insertion chamber opposite to the opening, and a plurality of terminal slots formed on the upright wall for accommodating the adapter terminals of the adapter means.

Further, the housing has a guide rod forwardly extending from the upright wall toward the insertion chamber, and the first ejection spring is sleeved onto the guide rod of the housing.

Preferably, the first ejection spring is a compression spring.

The drawer-type all-in-one card connector further includes a second ejection spring having two end tips fastened to the housing and the sliding box respectively.

Further, the sliding box has two positioning grooves, a movable block member mounted in the card receiving chamber for positioning a memory card in the card receiving chamber and having two positioning pins respectively coupled to the positioning grooves for guiding movement of the movable block along the vertical guide grooves, and spring means for positioning the movable block member in the card receiving chamber.

Further, the movable block member has at least one positioning plate for positioning a memory card in the card receiving chamber.

Further, the sliding box has an arched finger notch at one end remote from the terminal slots of the sliding box for easy access of the fingers to the inserted memory card.

Further, the cover has a substantially U-shaped cross-section, and a plurality of elastic portions for positioning a memory card in the sliding box.

Preferably, the adapter means is a flexible circuit board.

Further, the limiter includes a locating groove provided at one side of the sliding box, a locating rod having two ends fastened to a hole at the housing and a second end engaged into the locating groove, and a positioning plate for positioning the locating rod and keeping the second end of the locating rod in close contact with said locating groove.

DETAILED DESCRIPTION OF THE INVENTION

Figure 1:
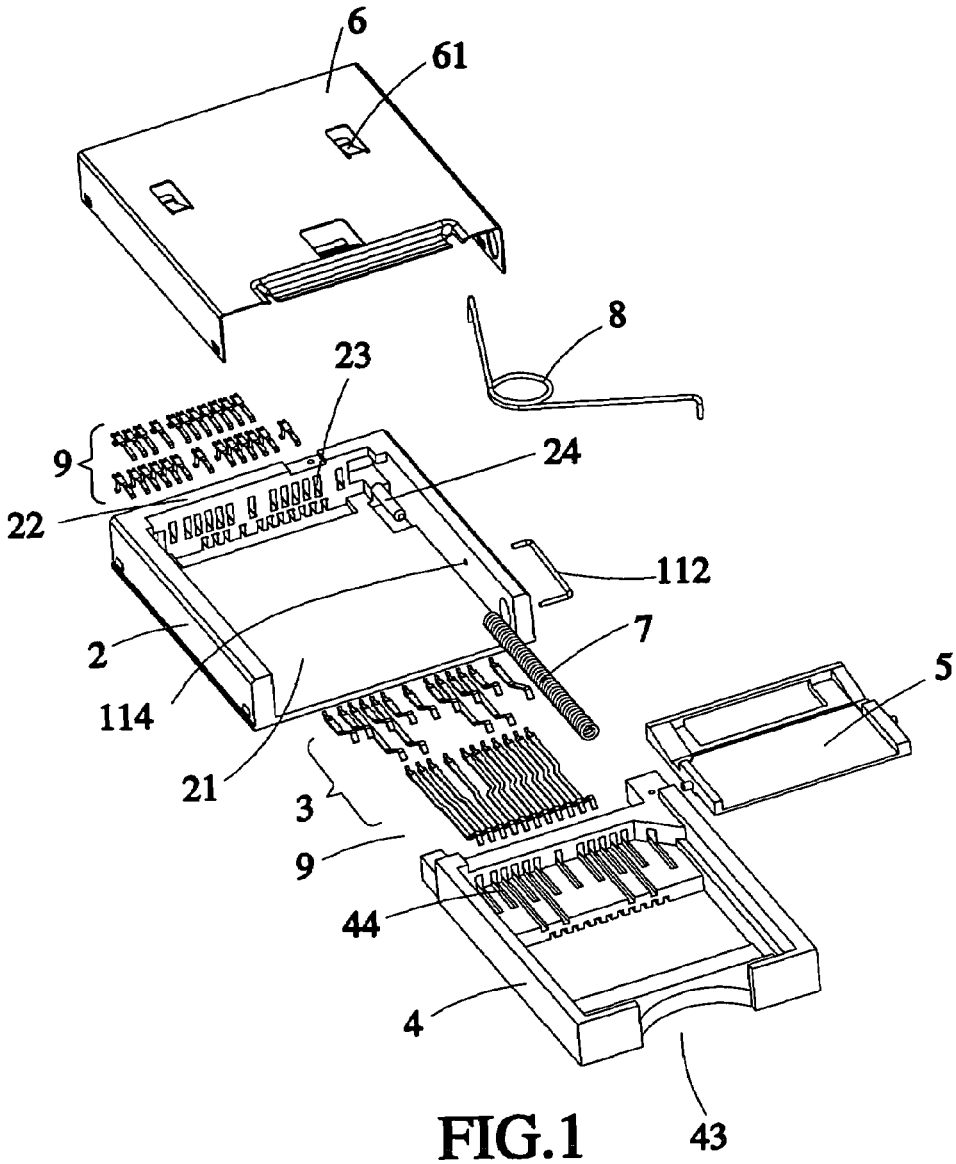
FIG. 1 is an exploded view of a drawer-type all-in-one card connector according to a first preferred embodiment of the present invention.
Figure 2:
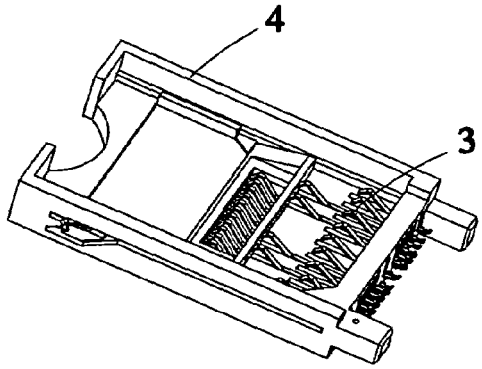
FIG. 2 is a perspective view of a part of the first preferred embodiment of the present invention, showing the card contact terminals installed in the sliding box.
Figure 3:
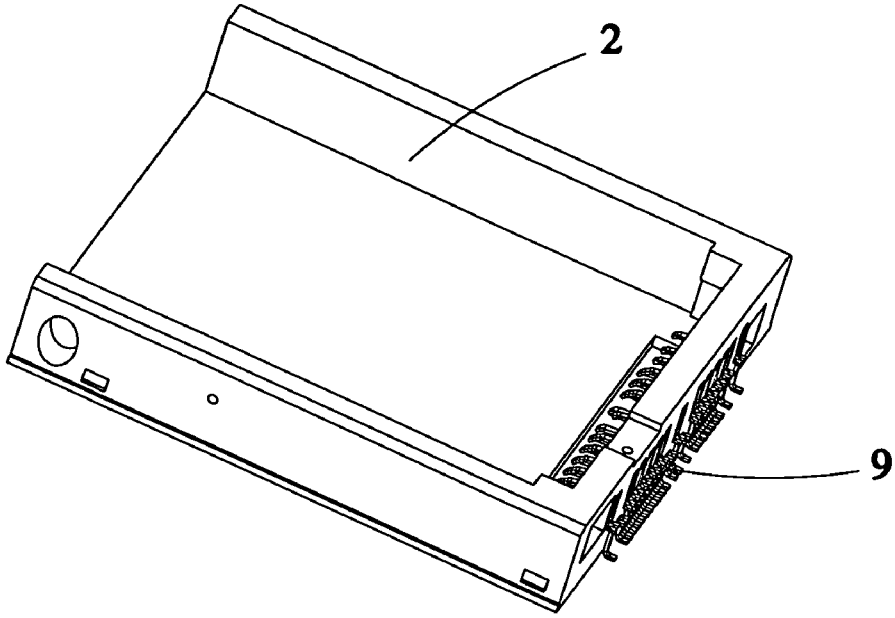
FIG. 3 is another perspective view of the first preferred embodiment of a part of the present invention, showing the adapter terminals installed in the housing.
Figure 4:
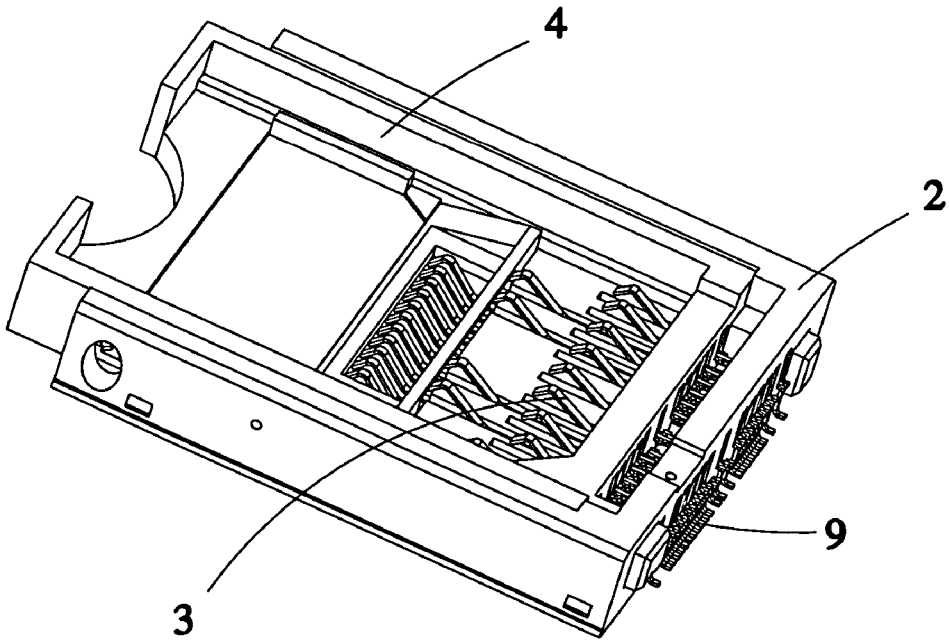
FIG. 4 is another perspective view of a part of the first preferred embodiment of the present invention, showing that the card contact terminals, the sliding box, the adapter terminals, and the housing are assembled.
Figure 5:
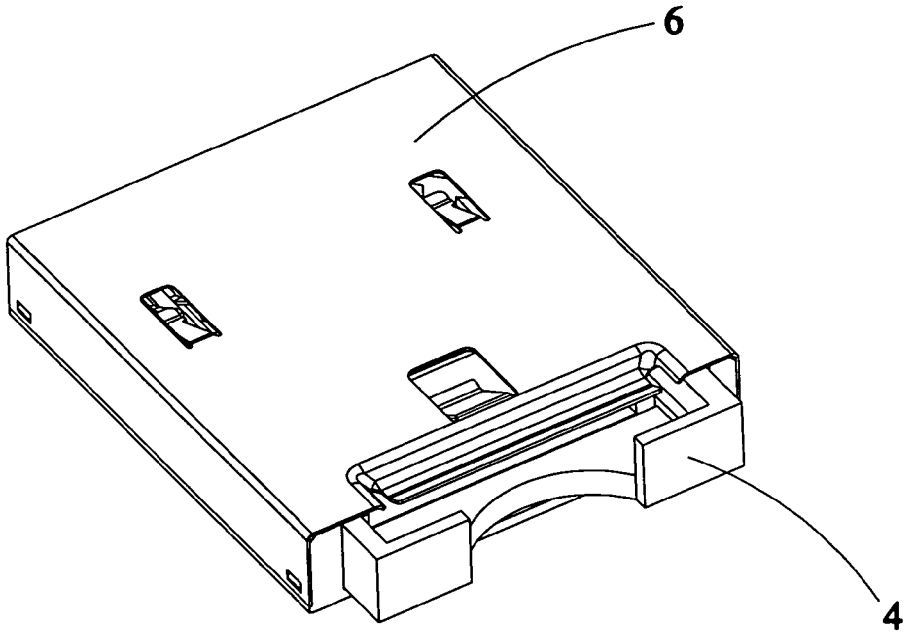
FIG. 5 is another perspective view of the drawer-type all-in-one card connector according to the first preferred embodiment of the present invention.
Figure 6:
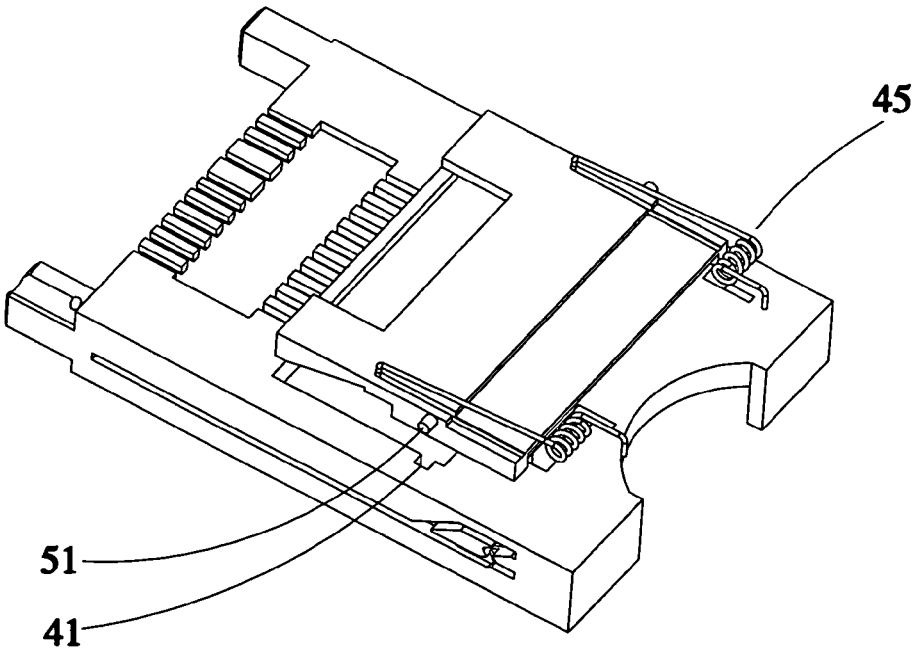
FIG. 6 is a schematic view of a part of the first preferred embodiment of the present invention, showing the positioning of the movable block member in the sliding box.

Referring to FIGS. 1-6, a drawer-type all-in-one card connector in accordance with the present invention is shown comprised of a housing 2, a plurality of card contact terminals 3, a sliding box 4, a movable block member 5, a cover 6, a first ejection spring 7, a second ejection spring 8, and a plurality of adapter terminals 9.

The housing 2 is rectangular, having an upright rear wall 22, an insertion chamber 21 horizontally forwardly extending from the upright rear wall 22 to a front opening thereof for receiving the sliding box 4, a plurality of sets of adapter terminal slots 23 formed on the upright rear wall 22 for mounting the adapter terminals 9, and a guide rod 24 forwardly extending from an inner side of the upright rear wall 22 toward the insertion chamber 21. After insertion of the sliding box 4 into the insertion chamber 21, data signals are transmitted from the card carried in the sliding box 4 through the card contact terminals 3 and then the adapter terminals 9 for output. Further, a limiter 11 is provided between the housing 2 and the sliding box 4.

The sliding box 4 is drawer-typed and is slidably inserted into the insertion chamber 21 of the housing 2, having two positioning grooves 41 symmetrically bilaterally disposed on an inside thereof for receiving the movable block member 5, an arched finger notch 43 formed at one end thereof, and a plurality of card terminal slots 44 disposed at the other end thereof for receiving the card contact terminals 3.

The movable block member 5 includes two positioning pins 51 symmetrically disposed at two opposite lateral sides and respectively mounted to the positioning grooves 41 to guide vertical movement of the movable block member 5 relative to the sliding box 4 along the positioning grooves 41. Further, spring members 45 are provided to hold the movable block member 5 in the sliding box 4, allowing the movable block member 5 to be moved by an internal force along the positioning grooves 41. The movable block member 5 and the sliding box 4 define a card receiving chamber capable of receiving any of a variety of memory cards including SD card, MMC card, RS-MMC (Reduced Size Multimedia Card) card, and MINI SD card.

The cover 6 has a substantially U-shaped cross-section, being covered on the housing 2. Further, the cover 6 has a plurality of elastic portions 61 for holding down the inserted memory card in the sliding box 4.

The first ejection spring 7 is a compression spring sleeved onto the guide rod 24 of the housing 2 and stopped between the upright rear wall 22 of the housing 2 and a part of the sliding box 4.

Figure 7:
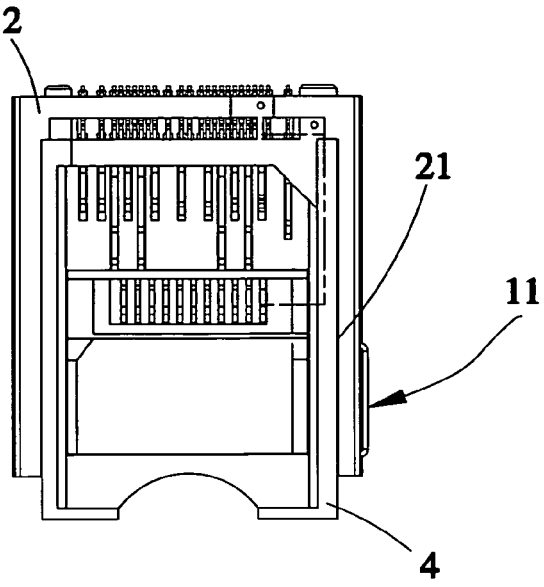
FIG. 7 is a schematic top view of a part of the first preferred embodiment of the present invention, showing the sliding box inserted into the housing.
Figure 8:
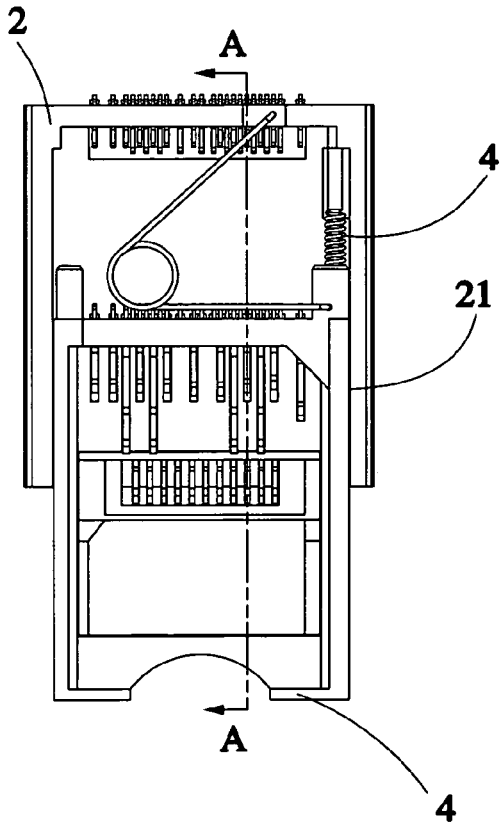
FIG. 8 is a schematic view of the first preferred embodiment of the present invention, showing that the first ejection spring forces the sliding box partially to eject out of the insertion chamber of the housing.
Figure 9:
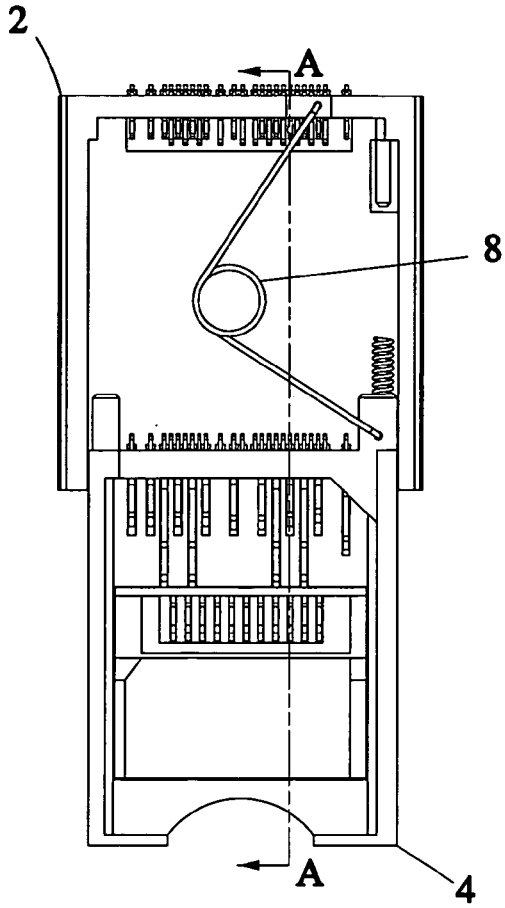
FIG. 9 is a schematic view of the first preferred embodiment of the present invention, showing the second ejection spring forces the sliding box to eject out of the insertion chamber of the housing.

FIGS. 7-9 show the ejection of the sliding box 4 out of the insertion chamber 21 of the housing 2. FIG. 7 shows the sliding box 4 inserted into the insertion chamber 21 and stopped in position by the limiter 11. FIG. 8 shows the sliding box 4 forced outwards from the insertion chamber 21 of the housing 2 by the first ejection spring 7. FIG. 9 shows the sliding box 4 ejected out of the insertion chamber 21 of the housing 2 by the second ejection spring 8. The second ejection spring 8 according to this embodiment is a torsional spring, having the two end tips thereof respectively fastened to the housing 2 and the sliding box 4.

Figure 10:
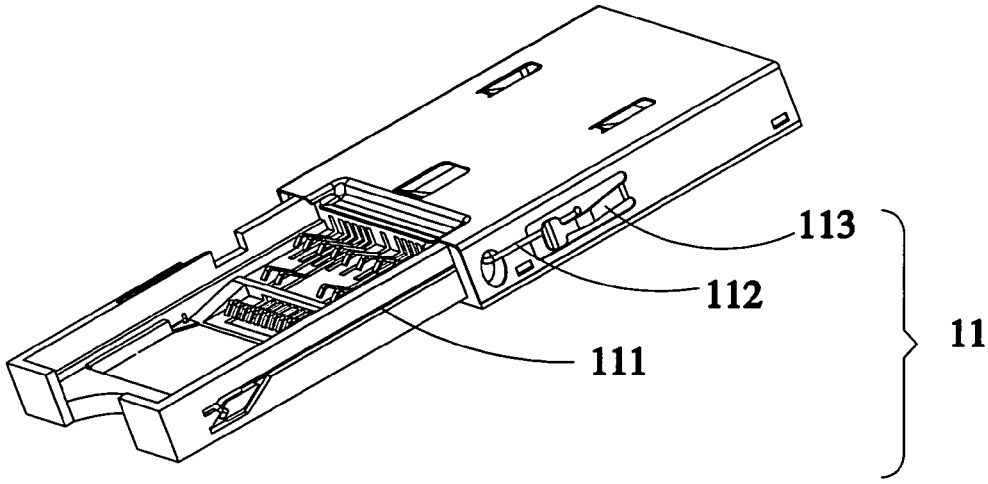
FIG. 10 is a schematic view of a part of the first preferred embodiment of the present invention, showing the structure of the limiter.

Referring to FIG. 10 and FIG. 1 again, the limiter 11 includes a locating groove 11, a locating rod 112, and a positioning plate 113. The locating groove 11 is provided at one side of the sliding box 4. The locating rod 112 has one end fastened to a positioning hole 114 at one side of the housing 2 adjacent to the positioning plate 113, and the other end engaging the locating groove 111. When the sliding box 4 receives an external force, the locating rod 112 limits the movement of the sliding box 4 of the housing 2 along the predetermined path.

In the aforesaid embodiment, the movable block member 5 is an independent member movably coupled to the sliding box 4. Alternatively, the movable block member 5 can be combined with the sliding box 4 in one piece.

Figure 11:
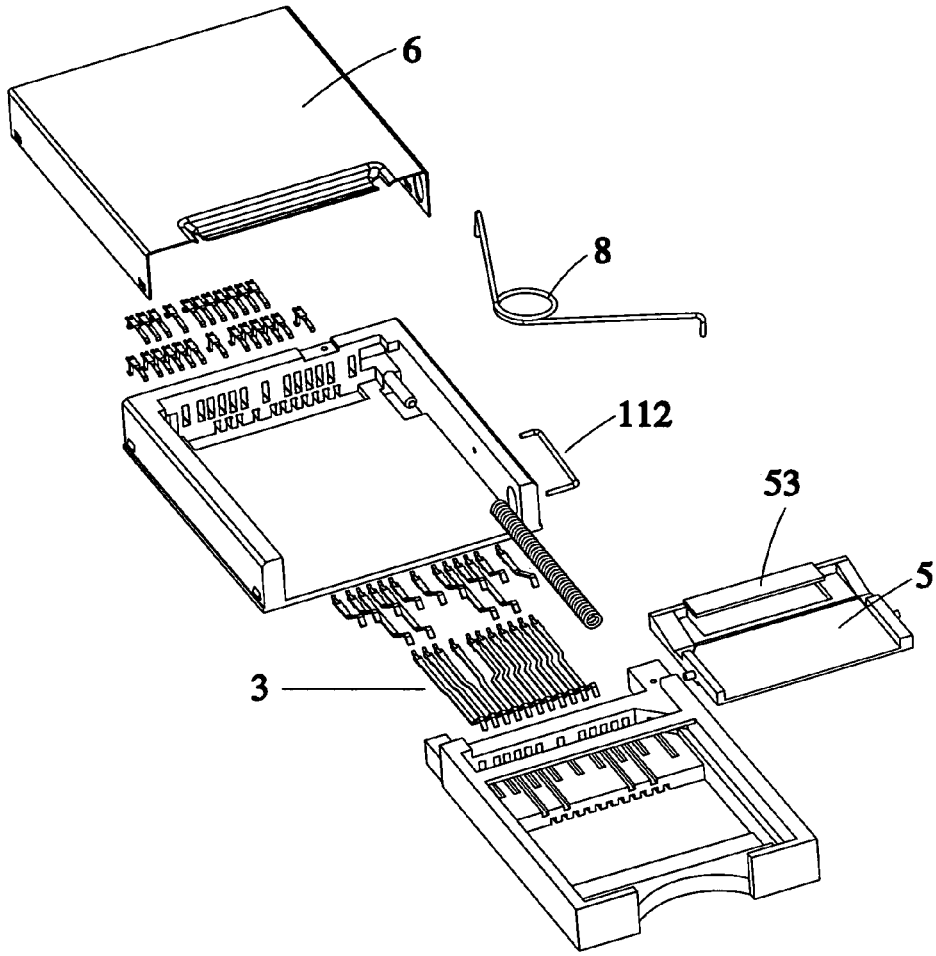
FIG. 11 is an exploded view of the drawer-type all-in-one card connector according to a second preferred embodiment of the present invention.
Figure 12:
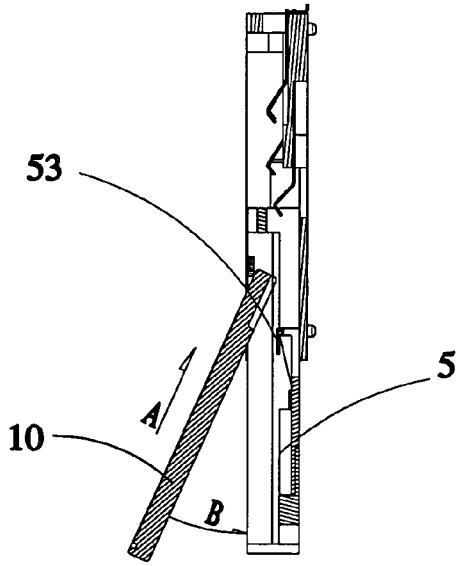
FIG. 12 is a schematic drawing showing a memory card obliquely inserted into the sliding box of the drawer-type all-in-one card connector according to the second preferred embodiment of the present invention.
Figure 13:
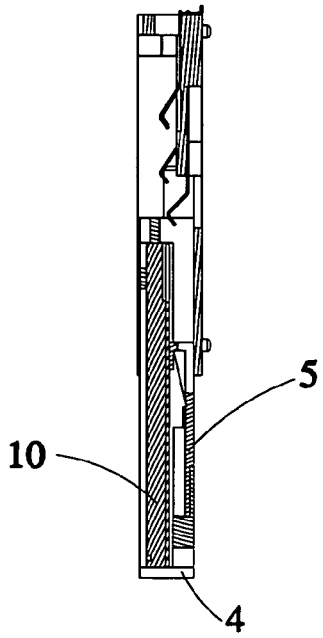
FIG. 13 corresponds to FIG. 12, showing the memory card inserted into and positioned in the sliding box.

FIG. 11 shows the drawer-type all-in-one card connector according to a second preferred embodiment the present invention. According to this embodiment, the movable block 5 has a positioning plate 53 at one side for positioning the inserted memory card. As shown in FIGS. 12 and 13, the memory card 10 is obliquely inserted into the inside of the sliding box 4 and then held down in position by the positioning plate 53 of the movable block member 5. In this embodiment, the aforesaid elastic portions 61 are excluded.

Figure 14:
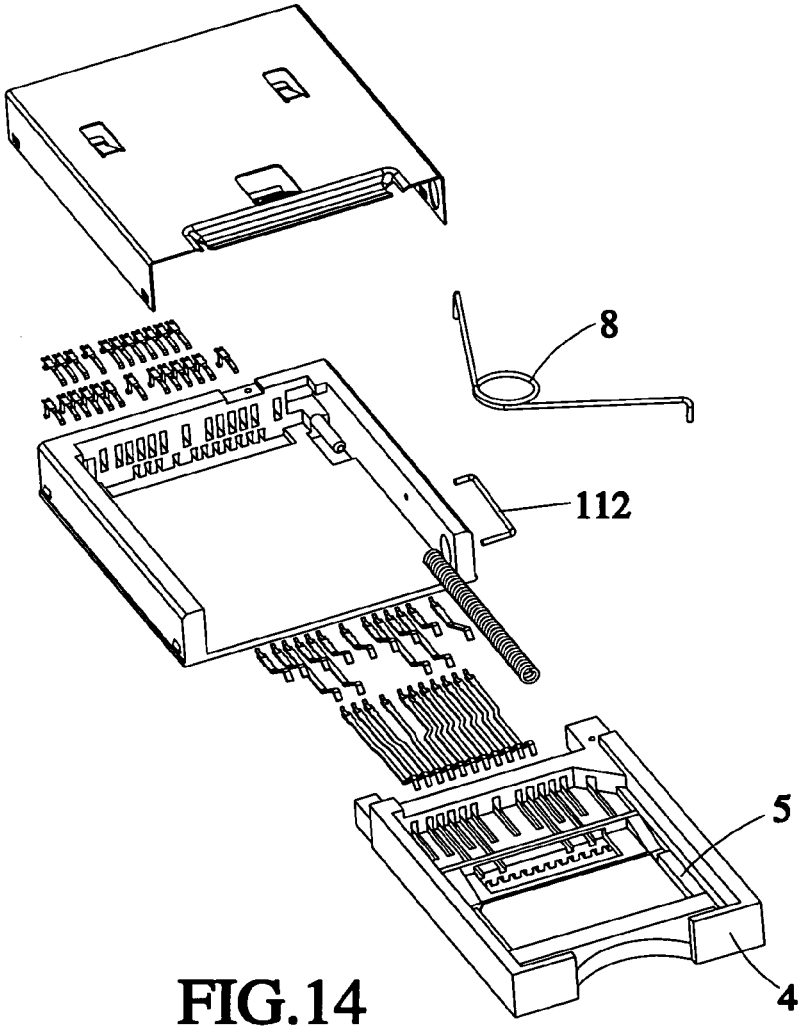
FIG. 14 is an exploded view of an alternative form of the drawer-type all-in-one card connector according to a third preferred embodiment of the present invention.
Figure 15:
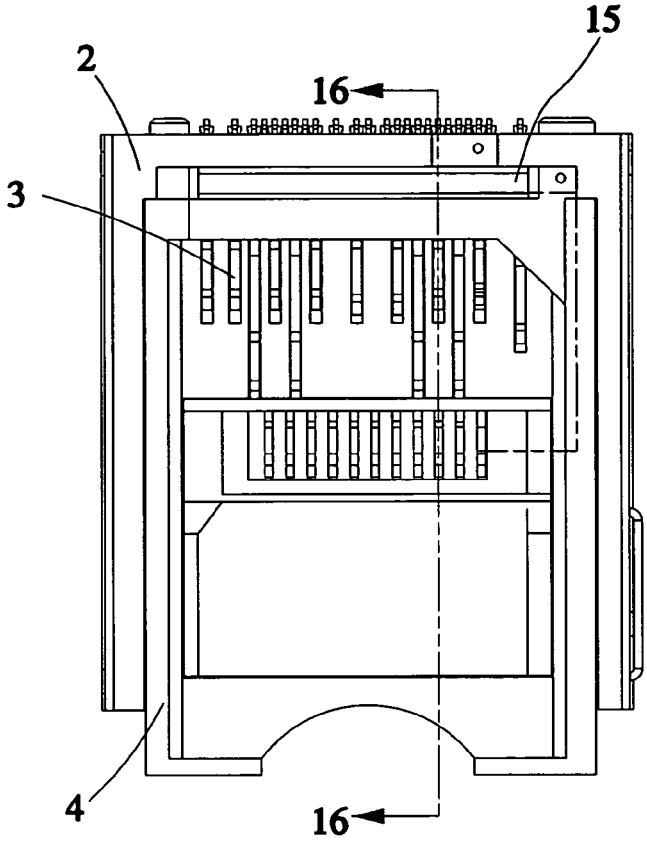
FIG. 15 is a schematic top view of the drawer-type all-in-one card connector according to a fourth preferred embodiment of the present invention.
Figure 16:
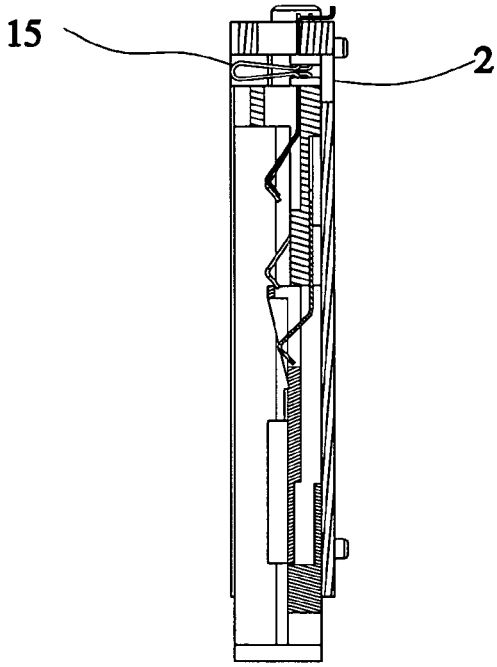
FIG. 16 is a sectional view taken from a line 16-16 indicated in FIG. 15.
Figure 17:
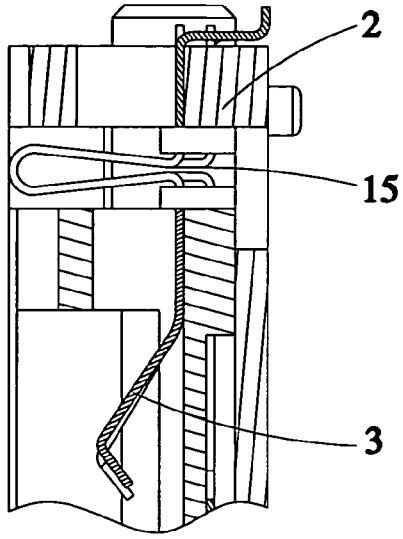
FIG. 17 is an enlarged view of a part of FIG. 16.
Figure 18:
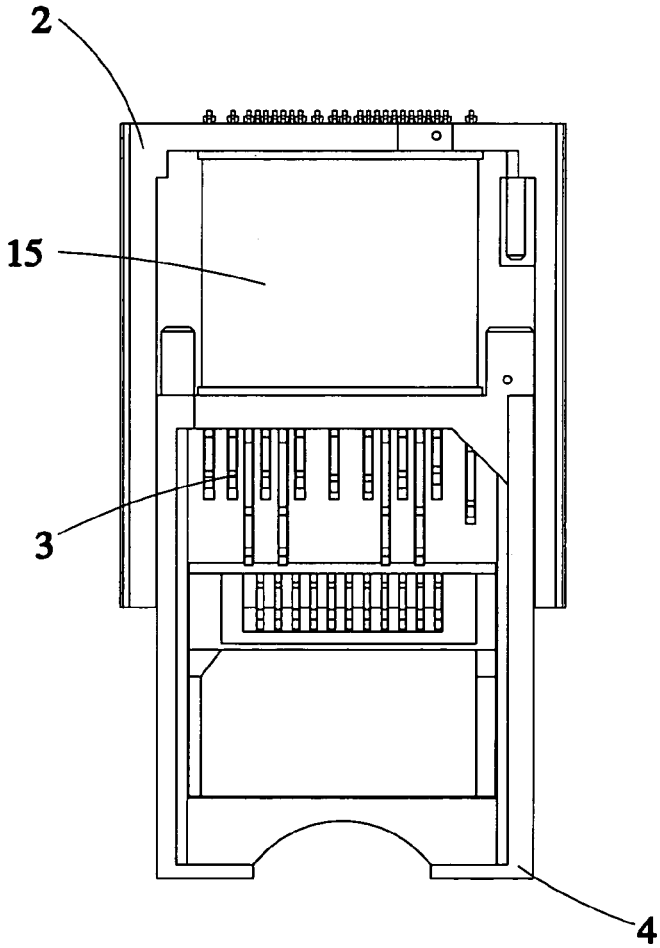
FIG. 18 corresponds to FIG. 15, showing the sliding box ejected out of the housing.

FIG. 14 shows a third preferred embodiment of the present invention. In this embodiment, the movable block member 5 is combined with the sliding box 4 in one piece.

FIGS. 15-18 show a fourth preferred embodiment of the present invention. In this embodiment, a flexible circuit board 15 is instead of the aforesaid adapter terminals. The flexible circuit board 15 has one end affixed to the housing 2 and electrically connected to the circuit board (not shown) in the housing 2, and the other end thereof connected to the card contact terminals 3 at the sliding box 4.

As indicated above, the drawer-type all-in-one card connector of the present invention employs the sliding box to hold down the inserted memory card, keeping the inserted memory card electrically connected to the card contact terminals and the adapter terminals. The present invention also allows insertion of any of a variety of memory cards.

By means of the sliding box, the inserted memory card is maintained positively electrically connected to the card contact terminals and the adapter terminals, avoiding damage to the internal structure of the connector due to improper insertion angle of the memory card.

By means of the ejection springs and the limiter, the memory card can conveniently and accurately be inserted into position or smoothly ejected out of the housing.

Further, with the arched finger notch at one end of the sliding box, the user can conveniently insert a memory card into the inside of the sliding box or remove the inserted memory card from the sliding box.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A drawer-type all-in-one card connector comprising:

a housing having an insertion chamber;

a plurality of card contact terminals;

a sliding box slidably mounted in said insertion chamber of said housing, said sliding box having a card receiving chamber for receiving a corresponding memory card, and a plurality of terminal slots accommodating said card contact terminals;

a cover covered on said housing;

a first ejection spring having two ends contacting against an inner sidewall of said housing and said sliding box respectively;

a limiter mounted between said housing and said sliding box; and adapter means having two ends electrically connected to a circuit board and connected to said card contact terminals respectively;

wherein said adapter means is a flexible circuit board for electric connection;

wherein said limiter further comprises a locating groove, a locating rod, and a positioning plate, said locating rod having two ends, one end being mounted to a positioning hole of said housing and the other end engaged said locating groove respectively, said positioning plate being provided for holding said locating rod and keeping one end of said locating rod fastened to the positioning hole of said housing for close contact with said locating groove.

2. The drawer-type all-in-one card connector as claimed in claim 1, wherein said adapter means further comprises a plurality of adapter terminals; said housing further comprises an opening formed at one end opposite to said insertion chamber, an upright wall formed at the other end thereof, and a plurality of terminal slots formed in said upright wall for accommodating said adapter terminals of said adapter means.

3. The drawer-type all-in-one card connector as claimed in claim 2, wherein said housing further comprises a guide rod extending from said upright wall toward said insertion chamber; said first ejection spring is sleeved onto said guide rod of said housing.

4. The drawer-type all-in-one card connector as claimed in claim 3, wherein said first ejection spring is a compression spring.

5. The drawer-type all-in-one card connector as claimed in claim 1 further comprising a second ejection spring, said second ejection spring having two end tips mounted to said housing and said sliding box respectively.

6. The drawer-type all-in-one card connector as claimed in claim 5, wherein said sliding box has an arched finger notch formed at one end remote from said terminal slots of said sliding box.

7. The drawer-type all-in-one card connector as claimed in claim 6, wherein said housing comprises a second ejection spring and a positioning hole formed at a top side thereof, said second ejection spring having two end tips mounted to said positioning hole and said sliding box respectively.

8. The drawer-type all-in-one card connector as claimed in claim 1, wherein said sliding box is drawer-typed and has a movable block member and two positioning grooves, said movable block member having two positioning pins respectively mounted to said positioning grooves, said movable block member being positioned on said sliding box by said positioning pins and said positioning grooves, vertical movement of said movable block member being forced by a spring mounted on said sliding box, said sliding box and said movable block member together defining a card receiving chamber for receiving a corresponding card.

9. The drawer-type all-in-one card connector as claimed in claim 8, wherein said movable block member has at least one positioning plate for positioning a memory card in said card receiving chamber.

10. The drawer-type all-in-one card connector as claimed in claim 1, wherein said cover has a substantially U-shaped cross-section and a plurality of elastic portions for positioning a memory card in said sliding box.

* * * * *